United States Patent [19]

Holbrook

[11] 3,942,800

[45] Mar. 9, 1976

[54] ARCHEOLOGICAL GAME

[76] Inventor: Dwight Holbrook, 1158 Fifth Ave., New York, N.Y. 10029

[22] Filed: Apr. 9, 1975

[21] Appl. No.: 566,440

[52] U.S. Cl. .. 273/135 AB; 273/134 C; 273/136 G; 273/152.2; 273/152.7 R; 273/157 R

[51] Int. Cl.[2] ..... A63F 3/04

[58] Field of Search ..... 273/130 R, 130 G, 131 AB, 273/131 BB, 134 AD, 134 C, 134 B, 134 D, 134 E, 134 G, 135 R, 135 AC, 135 AB, 135 AA, 136 K, 137 C, 137 D, 153 R, 157 R

[56] References Cited

UNITED STATES PATENTS

| | | | |
|---|---|---|---|
| 1,716,069 | 6/1929 | Loayza | 273/137 AC |
| 2,635,881 | 4/1953 | Cooney | 273/130 G |
| 3,334,903 | 8/1967 | Glass et al. | 273/134 C |
| 3,482,333 | 12/1969 | Trager, Jr. | 273/152.7 |
| 3,528,663 | 9/1970 | Curtz et al. | 273/135 R |
| 3,556,528 | 1/1971 | Spiring | 273/134 AC |
| 3,730,528 | 5/1973 | Corrado | 273/134 AD |
| 3,734,505 | 5/1973 | Germanis | 273/135 AC |
| 3,817,531 | 6/1974 | King et al. | 273/135 B |

*Primary Examiner*—Anton O. Oechsle
*Assistant Examiner*—Joseph R. Taylor
*Attorney, Agent, or Firm*—Hubbell, Cohen & Stiefel

[57] ABSTRACT

An archeological game utilizing common archeological techniques for locating an ancient buried civilization, termed the Great Civilization. The game interrelates two types of indicia bearing cards, termed fragment cards and clue cards, for determining the language of the ancient civilization from a plurality of possible languages and then deciphering the archeological fragments encrypted in that language to locate a predetermined number of fragments genuinely from that civilization, such as a predetermined number of mateable fragments which define a message, in order to be declared the finder of the ancient buried civilization. A fragment card may contain genuine encrypted language symbols as well as ingenuine or fake symbols not genuinely associated with the ancient civilization, such as forgeries or imports of another region than the known regional location of the ancient civilization. The game is played on a game board having a maplike area defining the archeological location in which information associated with the ancient buried civilization is located, with the maplike area being divided into a plurality of different coded, such as by color, adjacent areas each relating to rock stratum different adjacent historical ages. The clue cards and fragment cards are similarly coded with the fragment cards arranged at these locations in randomly provided stacks for selection therefrom. The language of the ancient civilization which must be initially determined is randomly variable from game to game dependent on the random arrangement and selection of the clue and fragment cards.

8 Claims, 53 Drawing Figures

FIG. 2.
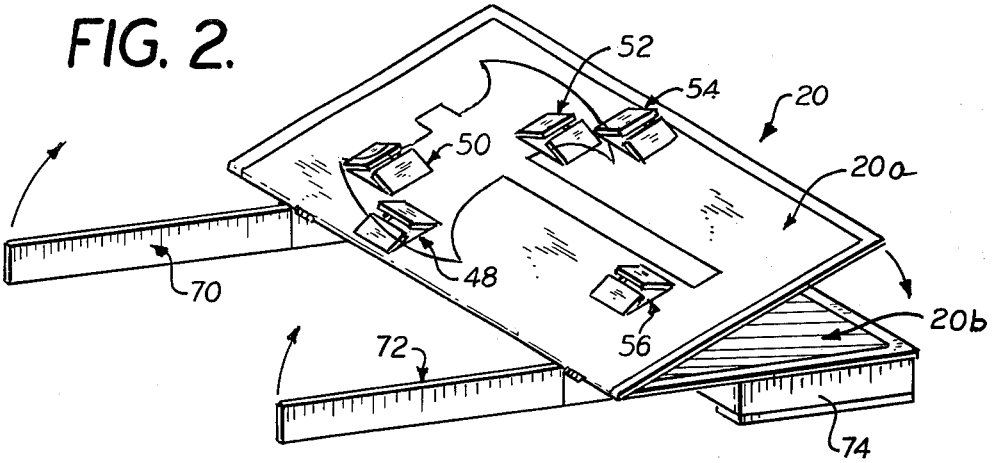
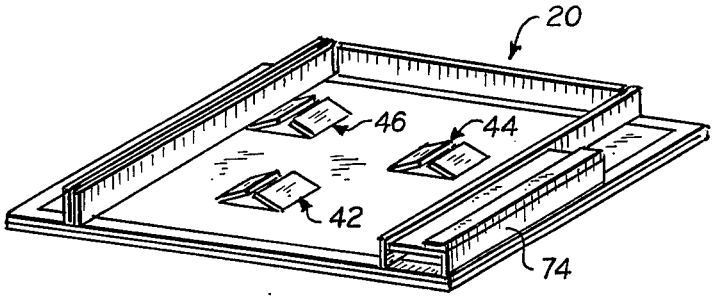
FIG. 3.
FIG. 4.
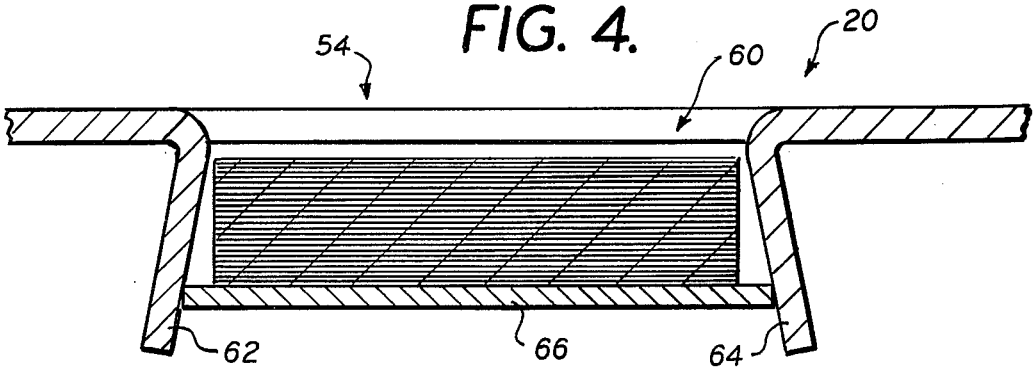
FIG. 5.
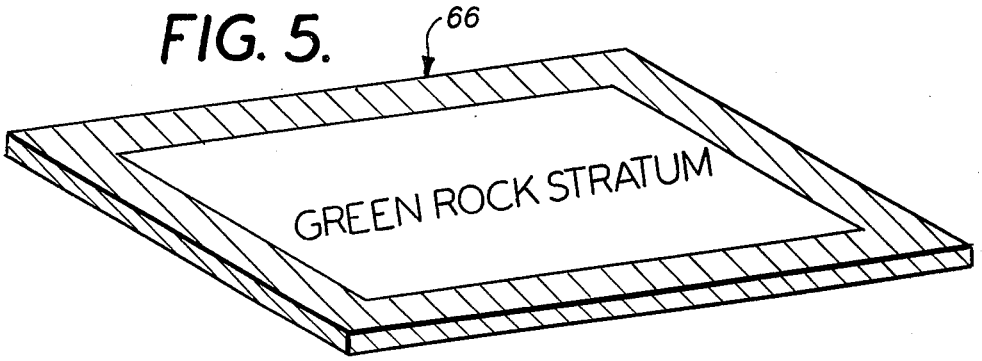

LANGUAGE: LINEAR 1
102
102a
102b
$ 50
"FINGERS"
104
104a
104b
$ 200
"AND THE YOUTHS"
106
106a
106b
$ 200
"WHISPERED THE"

LANGUAGE: ALPHABETIC
110
110a
100b
$ 300
"THEN THERE CAME CIRCE AND"

LANGUAGE: LINEAR 2
108
108a
108b
$ 200
"WHEN THE GREEN"

LANGUAGE: HIEROGLYPHIC
100
100a
100b
$ 100
"OIL FROM PROTEUS"

C Cards Giving the Meaning of Symbols

FIG. 10A.

E? O? Probably one of these vowels.

FIG. 10B.

= N

Report from a computer study of Linear 2.

FIG. 10C.

-FUL? -ING? -EST? Probably one of these three suffixes. Computer study report.

FIG. 10D.

Earlier and later versions of the letter V, from Hieroglyphic (left) to Linear 2 (right).

FIG. 10E.

It comes in front of many thing words. Probably means OF? TO?

FIG. 10F.

= Y

Results of a computerized study lead to this conclusion.

FIG. 10G.

= K, C

Conclusion is based on a computerized study of Linear 2.

FIG. 10H.

=

The first letter belongs to Linear 2, the second letter to Alphabetic.

C Cards: Front and Back Views

C Cards Giving Clues About Forgeries, Imports, and Potters' Designs

FIG. 12A.

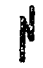

A forgery. The letter was made by a modern hand. Discard any fragment with this letter.

FIG. 12B.

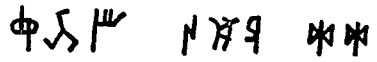

A fragment might look like the real thing, but if it has one letter which you know is a fake or forgery discard it. The whole thing is a hoax.

FIG. 12C.

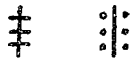

The first letter is Alphabetic. The second letter is a modern forgery. Discard any fragment with that letter.

FIG. 12D.

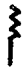

An import. Found on Minyan pottery from Asia. This letter does not belong to one of the four languages of Kalliste.

FIG. 12E.

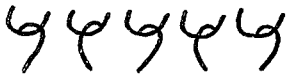

These are not letters. They have no meaning but are only part of a decorative design found on ancient pottery.

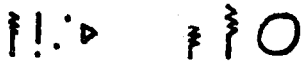

A fragment might look like the real thing, but if it has one letter which you know is an import the whole thing is an import. Discard it.

FIG. 12F.

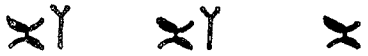

A letter might be a letter or it might be just a decorative mark on a fragment of pottery. Decorative marks usually repeat themselves as they do on wallpaper.

FIG. 12G.

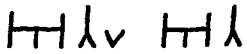

A potter's design. These are not letters. They have no meaning.

FIG. 12H.

C Cards (two shown with fragments)
Giving Evidence Relating to the Great
Civilization Language

FIG. 13A.

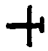

Letter scrawled on fragment buried under scoria. Discovered beside loom weights dating back to the Great Civilization period.

FIG. 13B.

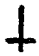

Fragments with this letter were composed after 1600 B.C. but before the volcanic eruption of 1500 B.C. Thermoluminescence analysis.

FIG. 13C.

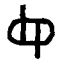

Letter inscribed on stone lamp. Lamp was found in a deposit of Neolithic tools dating back to 3,000 B.C.

FIG. 13D.

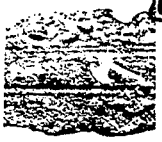

Part of inlaid dagger. Obsidian. Great Civilization period.

FIG. 13E.

FRAGMENT

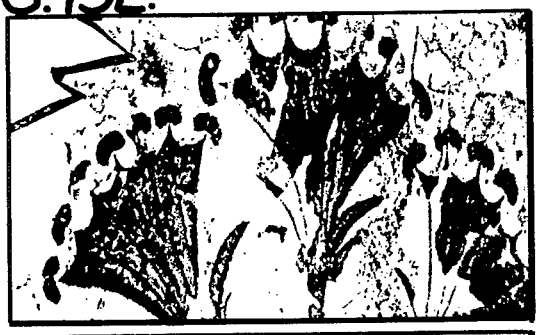

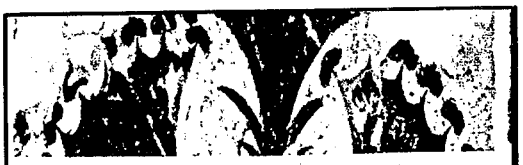

Sea daffodils. Fresco detail. Great Civilization period.

FIG. 13F.

FRAGMENT

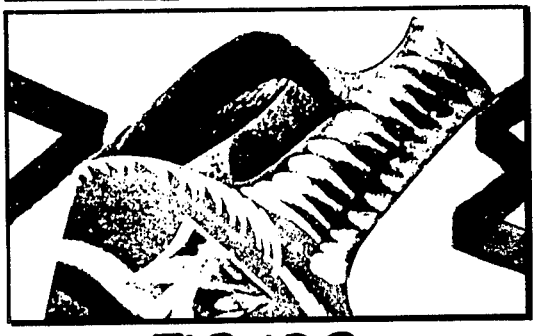

FIG. 13G.

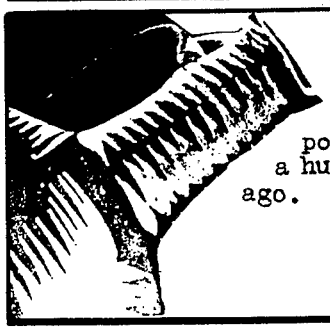

Modern imitation pottery. Made a hundred years ago.

FIG. 13H.

C Cards Giving Clues Other Than the Meaning of Symbols

FIG. 14A.

These letters are not the same. They come from two different languages, Linear 1 (left) and Linear 2 (right), a later language.

FIG. 14B.

Alphabetic. "Triple tongue" was an expression used at that time, according to an ancient historian. It meant speaking false words.

FIG. 14C.

Linear 1 letter. According to ancient myth the moon had secret powers which the people of this time unlocked.

FIG. 14D.

Linear 2. The function of a night watchman during those times was not to look out for enemies but to keep an eye on the active volcanic mountain to the west.

FIG. 14E.

These words all begin the same way but end differently, like "me," "mine," and "my" in our own language.

FIG. 14F.

Huge storage jars with this inscription on them were found intact. Once containing grain, they belong to the Great Civilization period.

FIG. 14G.

Clay tablets with this letter were found in the archives room of an excavated palace. The words on the tablets probably record information about how the estate was managed.

FIG. 14H.

Found on a pottery fragment with a picture of a sea nymph in an underwater cave.

FIG. 15A.

<u>The Alphabetic Decipherment</u>

The donkeys that climb up the
steep steps of Kalliste were once
human like ourselves. But they were
unlucky victims of Circe's power and
magic. They were the lovers of
Circe, and it was she who
turned these men our brothers of
Kalliste into donkeys. Beware the
triple tongue goddess. Odysseus,
beware Circe who turns men into
beasts. Beware the octopus who lives
under the channel waters of Kalliste.
She is waiting for you, Odysseus.

FIG. 15B.

The Alphabetic Decipherment (Con'd)

She is waiting for our men to return in their fishing boats.

There was once an ancient people on Kalliste. Then there came Circe, and the troubles began. She made her home under the slippery rocks of the shore, and from then on our sponge divers have been in constant danger. Listen to the donkeys of Kalliste. Listen carefully.

They know who hides in the shallow caves.

FIG. 16A.

The Hieroglyphic Decipherment

During the eclipse the royal man

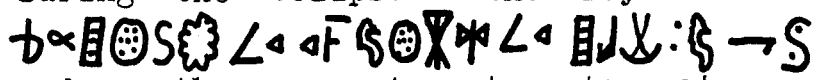

orders the servant to stay at

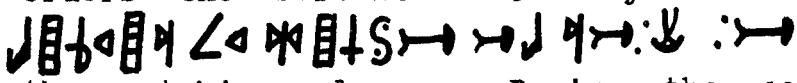

the watching place. During the eclipse

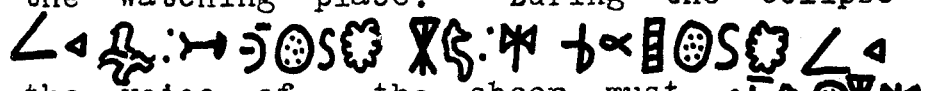

the voice of the sheep must

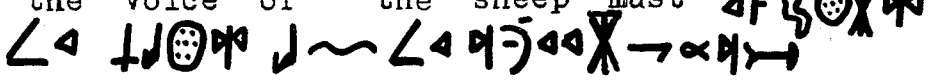

not be heard. During the eclipse

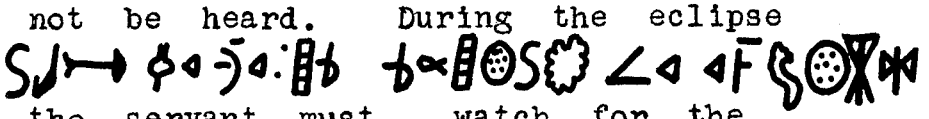

the servant must watch for the

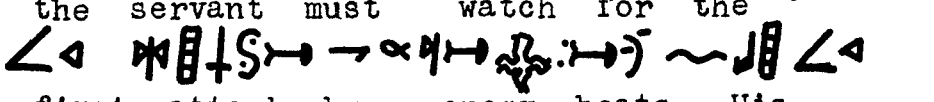

first attack by enemy boats. His

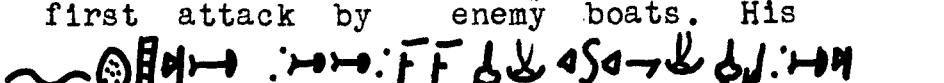

eyes are open day and night

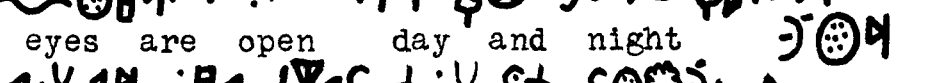

from the day of the eclipse

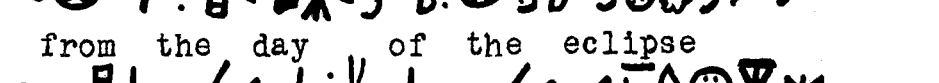

until two nights after. For the

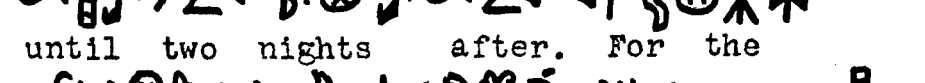

attack is surely coming and the

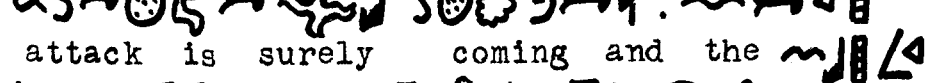

royal man tells Thereus to gather

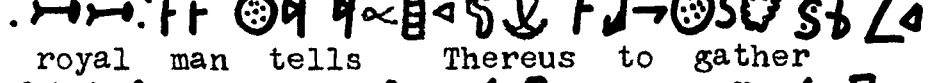

four forces of soldiers from Oea

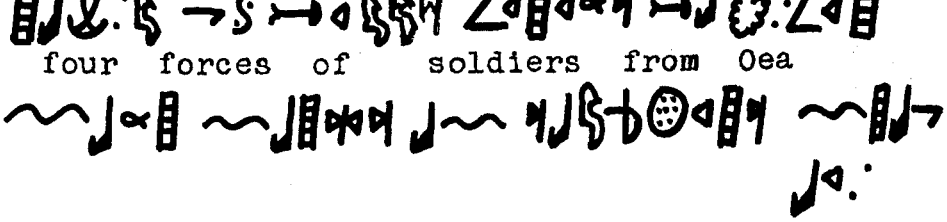

FIG. 16B.

The Hieroglyphic Decipherment (Con'd)

and Akrotiri and to gather these

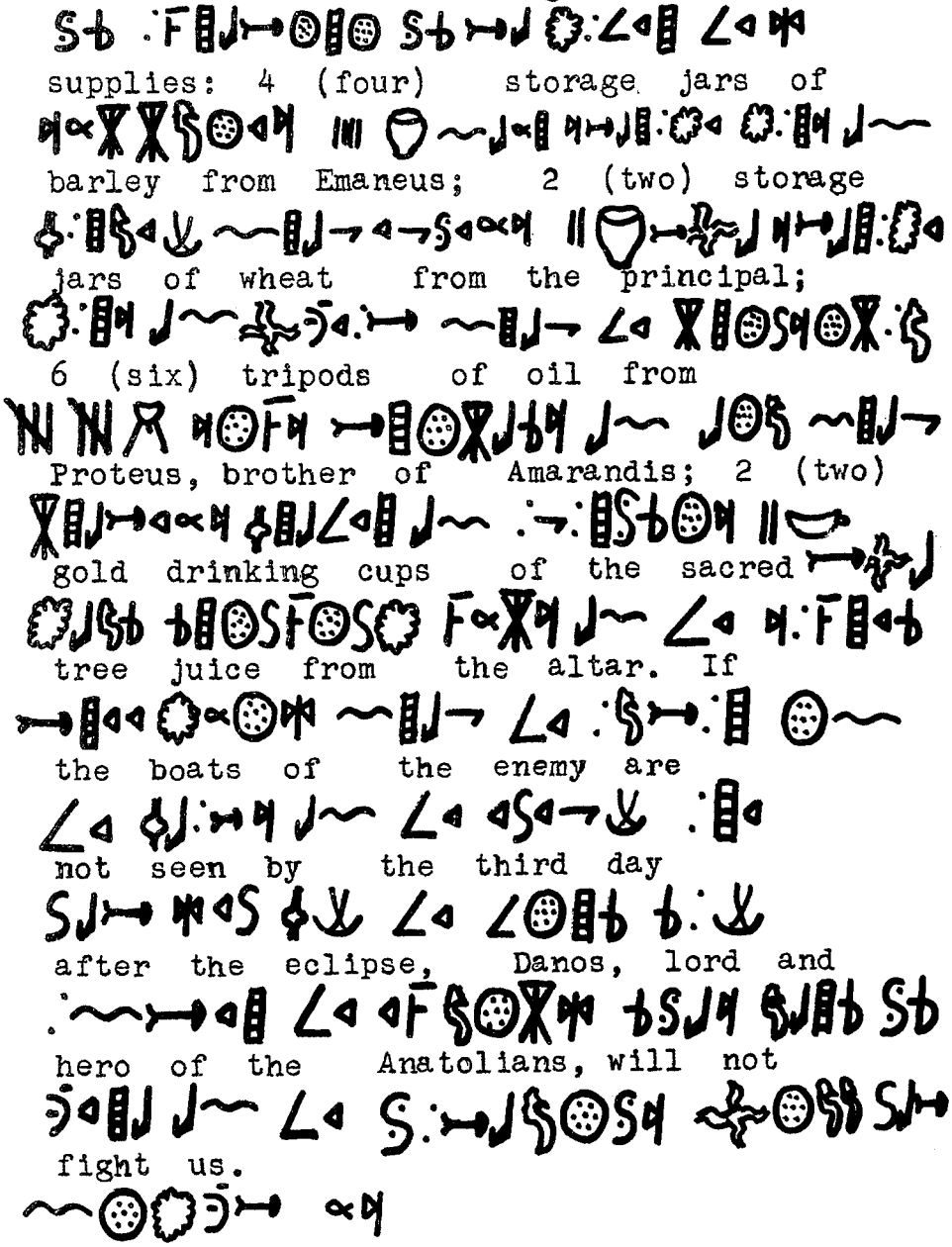

supplies: 4 (four) storage jars of
barley from Emaneus; 2 (two) storage
jars of wheat from the principal;
6 (six) tripods of oil from
Proteus, brother of Amarandis; 2 (two)
gold drinking cups of the sacred
tree juice from the altar. If
the boats of the enemy are
not seen by the third day
after the eclipse, Danos, lord and
hero of the Anatolians, will not
fight us.

FIG. 17A.

The Linear 1 Decipherment

The priestess received forty horns of

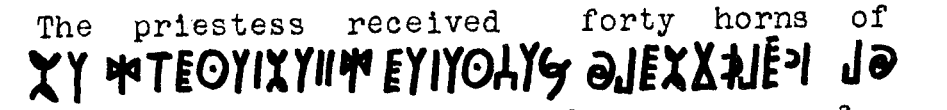

bulls and three hundred measures of

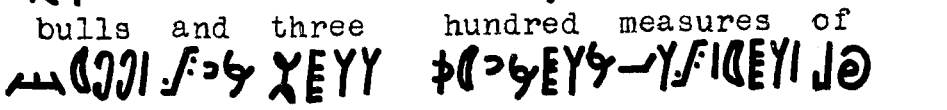

oil for the blessed lady. She

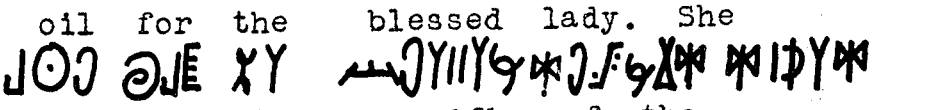

then put these gifts of the

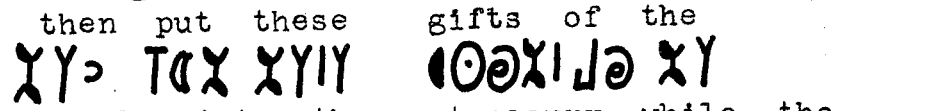

people into the treasury while the

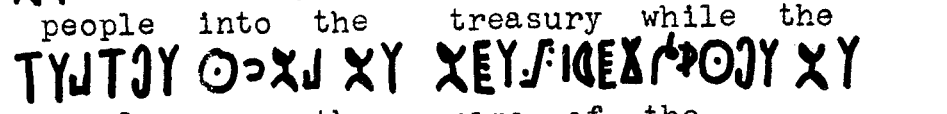

people sang the name of the

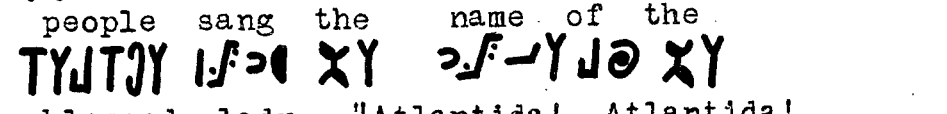

blessed lady. "Atlantida! Atlantida!

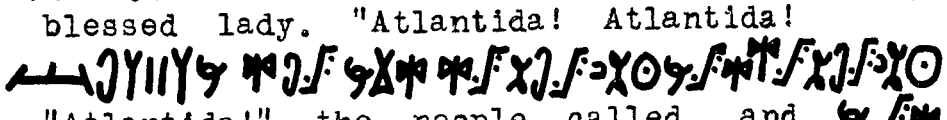

"Atlantida!" the people called, and

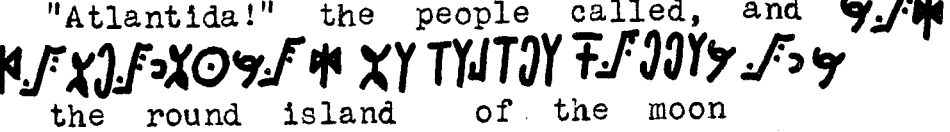

the round island of the moon

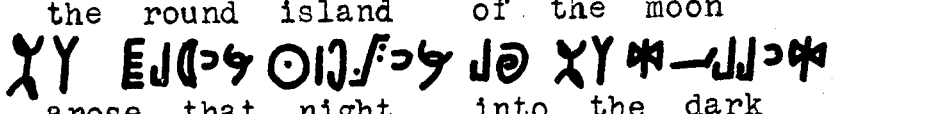

arose that night into the dark

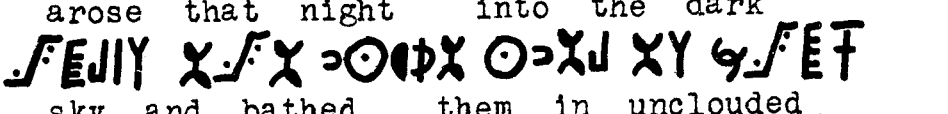

sky and bathed them in unclouded

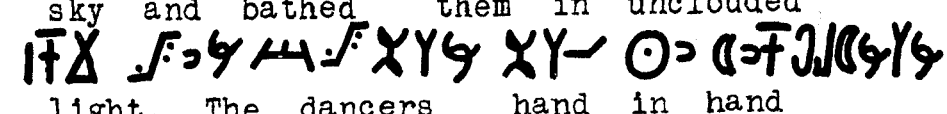

light. The dancers hand in hand

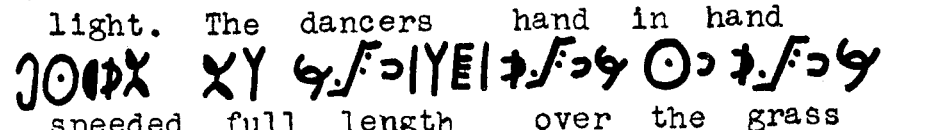

speeded full length over the grass

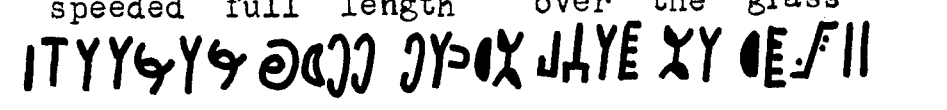

FIG. 17B.

The Linear 1 Decipherment (Con'd)

and hills, as the echoes of

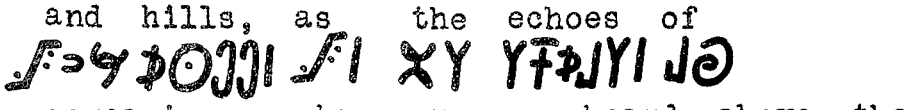

screaming monkeys were heard above the

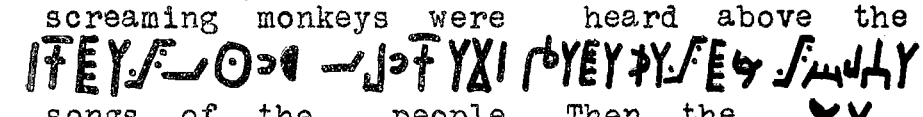

songs of the people. Then the

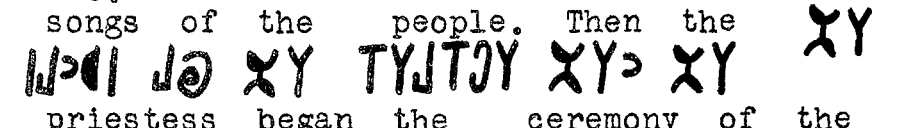

priestess began the ceremony of the

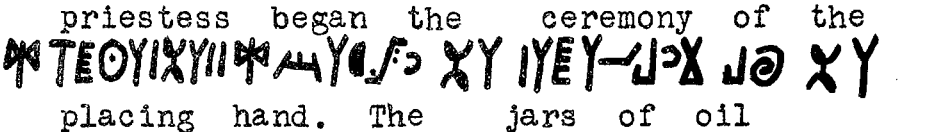

placing hand. The jars of oil

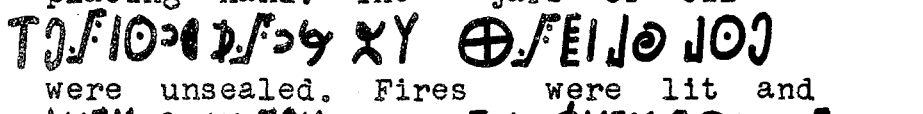

were unsealed. Fires were lit and

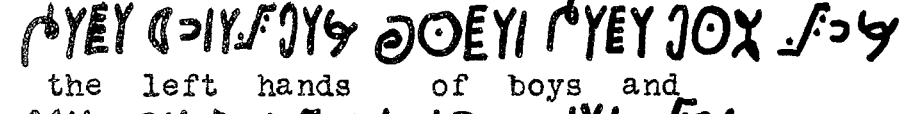

the left hands of boys and

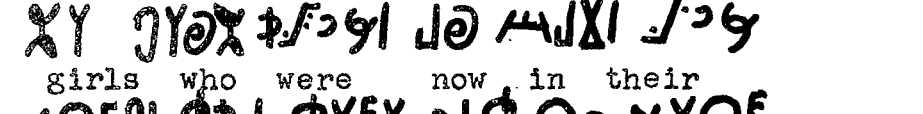

girls who were now in their

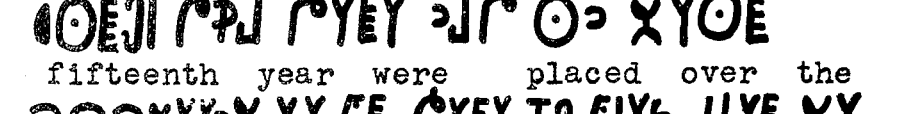

fifteenth year were placed over the

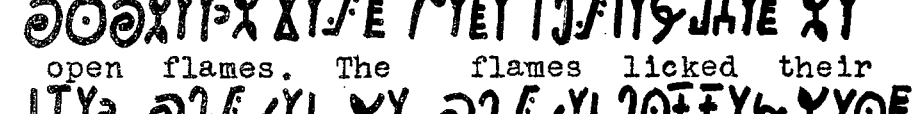

open flames. The flames licked their

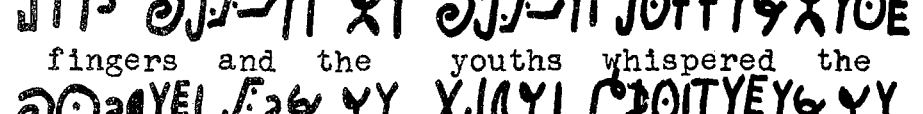

fingers and the youths whispered the

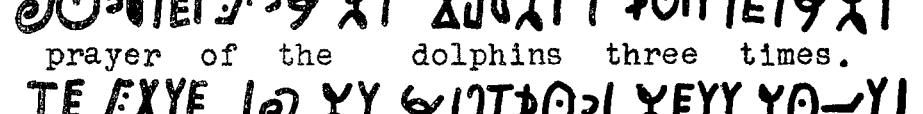

prayer of the dolphins three times.

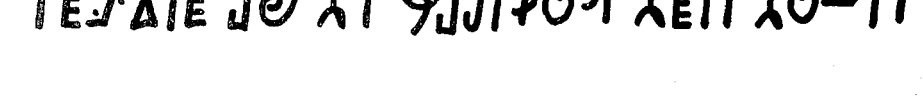

FIG. 18A.

The Linear 2 Decipherment

The night watch sends word that

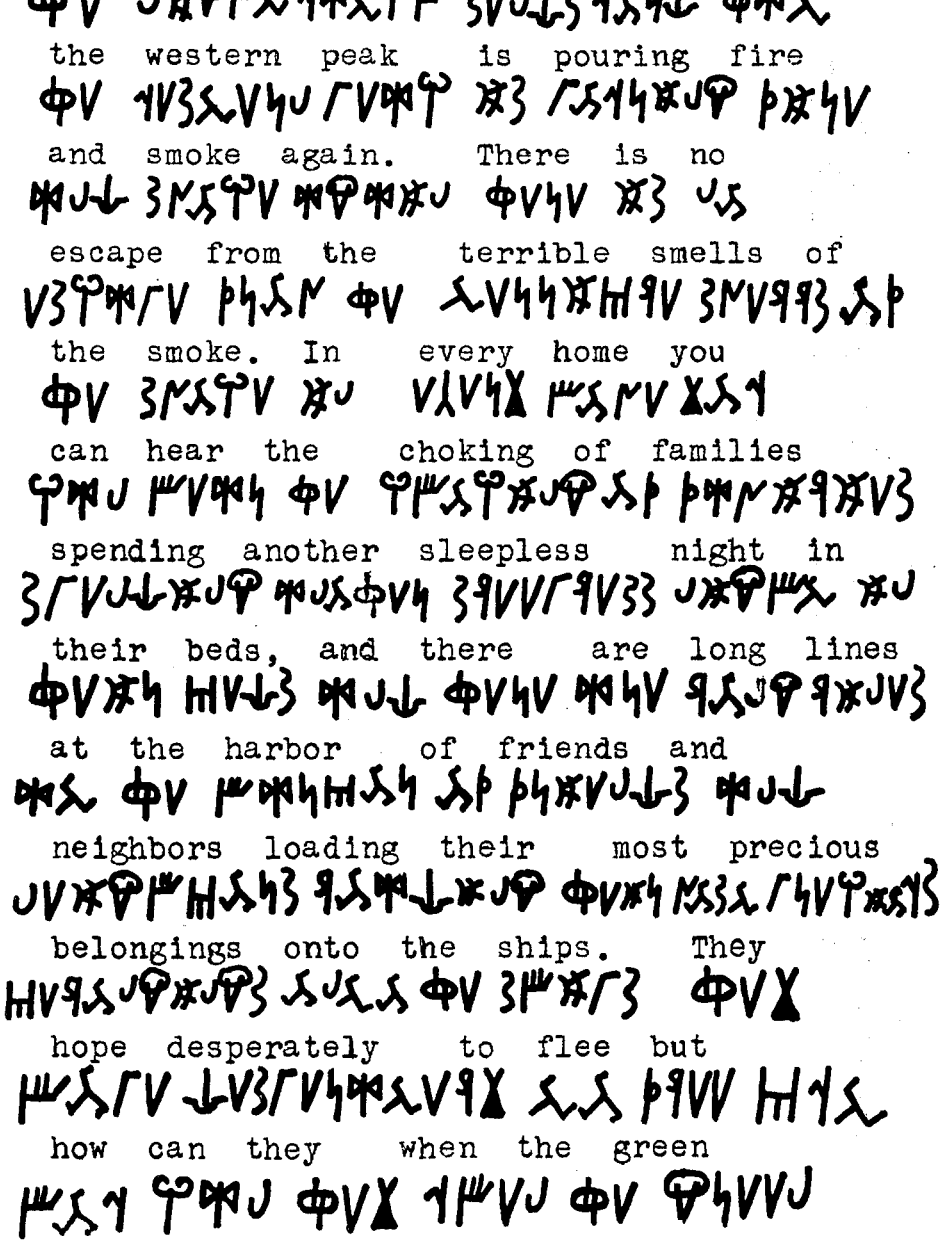

the western peak is pouring fire and smoke again. There is no escape from the terrible smells of the smoke. In every home you can hear the choking of families spending another sleepless night in their beds, and there are long lines at the harbor of friends and neighbors loading their most precious belongings onto the ships. They hope desperately to flee but how can they when the green

FIG. 18B.

The Linear 2 Decipherment (Con'd)

flames of the fire are crawling across the sea? Even the dolphins are floating lifeless on the sea.

The days are as dark as the nights, and the oil lamp cannot burn any longer. Oh tell me who is there left to pray to? I know that I will not live long but perhaps these words on clay which I write down will live longer.

ARCHEOLOGICAL GAME

BACKGROUND OF THE INVENTION

1. Field of the Invention

The present invention relates to an archeological board game for a plurality of players.

2. Description of the Prior Art

Board games are well known such as those in which various clues are collected during the game in order to win the game by employing these clues. Such a typical game is one commercially available from Parker Brothers under the name "Clue." Other such games of this type are distributed, for example, by Minnesota Mining and Manufacturing in their "Book Shelf" series. Further examples of such games, are disclosed in U.S. Pat. Nos. 1,491,536; 3,117,789 and 2,635,881. In addition, archeological games, that is ones simulating an archeological expedition, are also well known, such as the game of "Exploration" described in U.S. Pat. No. 3,556,528. However, none of these prior art games known to the inventor herein employ the basic archeological techniques for locating an ancient buried civilization of finding fragments of the language of the ancient buried civilization, then initially determining what these fragments mean and thereafter collecting sufficient evidence to prove that the fragments found genuinely belong to the ancient buried civilization and provide genuine information relating thereto, particularly in such a game in which the ancient buried civilization, which may have any one of several possible languages, may be randomly varied from game to game.

SUMMARY OF THE INVENTION

An archeological game apparatus for a plurality of players for finding an ancient buried civilization is provided. The game comprises a game board having a maplike area defining an archeological location in which information associated with the ancient buried civilization is located. The maplike area is divided into a plurality of different coded, such as by color, adjacent areas each relating to rock stratum of a different adjacent historical age relative to the ancient buried civilization. A plurality of indicia bearing fragment cards are located at predetermined locations in each of the different coded areas, such as in pockets located in the game board, and are arranged at these locations in randomly provided stacks for selection therefrom during the playing of the game. At least a portion of this plurality of fragment cards contains encrypted language symbols indicia thereon associated with one of a predetermined plurality, such as four, of different encrypted languages, only one of which genuinely belongs to the ancient civilization for a given game. At least another portion of the fragment cards contains indicia thereon which is not genuinely associated with the ancient civilization, such as forgeries or imports from a region outside the maplike area and, accordingly, is a fake with respect to the ancient civilization to be found. Each of the fragment cards has a code thereon associated with a particular stratum code and indicative of the relative age of a given one of the fragment cards with respect to another.

A plurality of indicia bearing clue cards are also provided with these clue cards being arranged in at least one randomly provided stack for selection therefrom. The clue cards contain indicia for decrypting the encrypted language symbols contained on the fragment cards including indicia relating to the genuine meaning of language symbols and evidence of the association between these language symbols and the ancient civilization, such as whether a given fragment card is a forgery or import or genuinely attributable to the acient buried civilization which is being sought. The clue cards have at least one code thereon corresponding to a particular stratum code. The clue cards are interrelated with or cooperatively associated only with those fragment cards having the same stratum code thereon. In playing the game, clue cards and fragment cards are cooperatively associated or interrelated in order to initially determine the language of the ancient civilization from a plurality of different possible languages and for subsequently decrypting a predetermined quantity of the fragment cards in the initially determined language to translate the language symbols thereon in the initially determined language. The ancient buried civilization is found when this predetermined quantity of fragment cards is translated and identified by the clue cards as genuinely belonging to the ancient civilization. The language which is initially determined to belong to the ancient buried civilization is randomly variable from game to game dependent on the random arrangement and selection of the clue and fragment cards.

BRIEF DESCRIPTION OF THE DRAWINGS

FIG. 2 is a perspective view of the game board of FIG. 1 illustrated during the closing thereof upon the completion of the game;

FIG. 3 is a perspective view of the game board illustrated in FIGS. 1 and 2 in the closed position;

FIG. 4 is a fragmentary cross sectional view of a typical preferred card holding portion of the game board of FIG. 1 taken along line 4—4;

FIG. 5 is a perspective view of a typical preferred insert for the card holding portion illustrated in FIG. 4;

FIGS. 10A through 10H are plan views of typical clue cards, termed "C cards" giving the meaning of symbols located on the fragment cards;

FIGS. 12A through 12H are plan views of other typical clue cards or C cards giving clues about forgeries, imports, and potters' designs for use in playing the preferred archeological game;

FIGS. 13A through 13H are plan views of still other typical clue cards or C cards giving evidence relating to the language of the ancient buried civilization, the Great Civilization, for use in playing the preferred archeological game;

FIGS. 14A through 14H are plan views of still other clue cards or C cards giving clues other than the meaning of symbols for use in playing the preferred archeological game;

FIGS. 15A and 15B taken together comprise the translation or decipherment of one of the typical preferred languages, termed "Alphabetic", used in playing the preferred archeological game;

FIGS. 16A and 16B taken together comprise a translation or decipherment of another typical preferred language, termed "Hieroglyphic" used in playing the preferred archeological game;

FIGS. 17A and 17B taken together comprise the translation or decipherment of still another typical preferred language, termed "Linear 1" used in playing the preferred archeological game; and FIGS. 18A and 18B taken together comprise the translation or decipherment of still another typical preferred language, termed "Linear 2" used in playing the preferred archeological game of the present invention.

DETAILED DESCRIPTION OF THE PREFERRED EMBODIMENT

Figure 1:
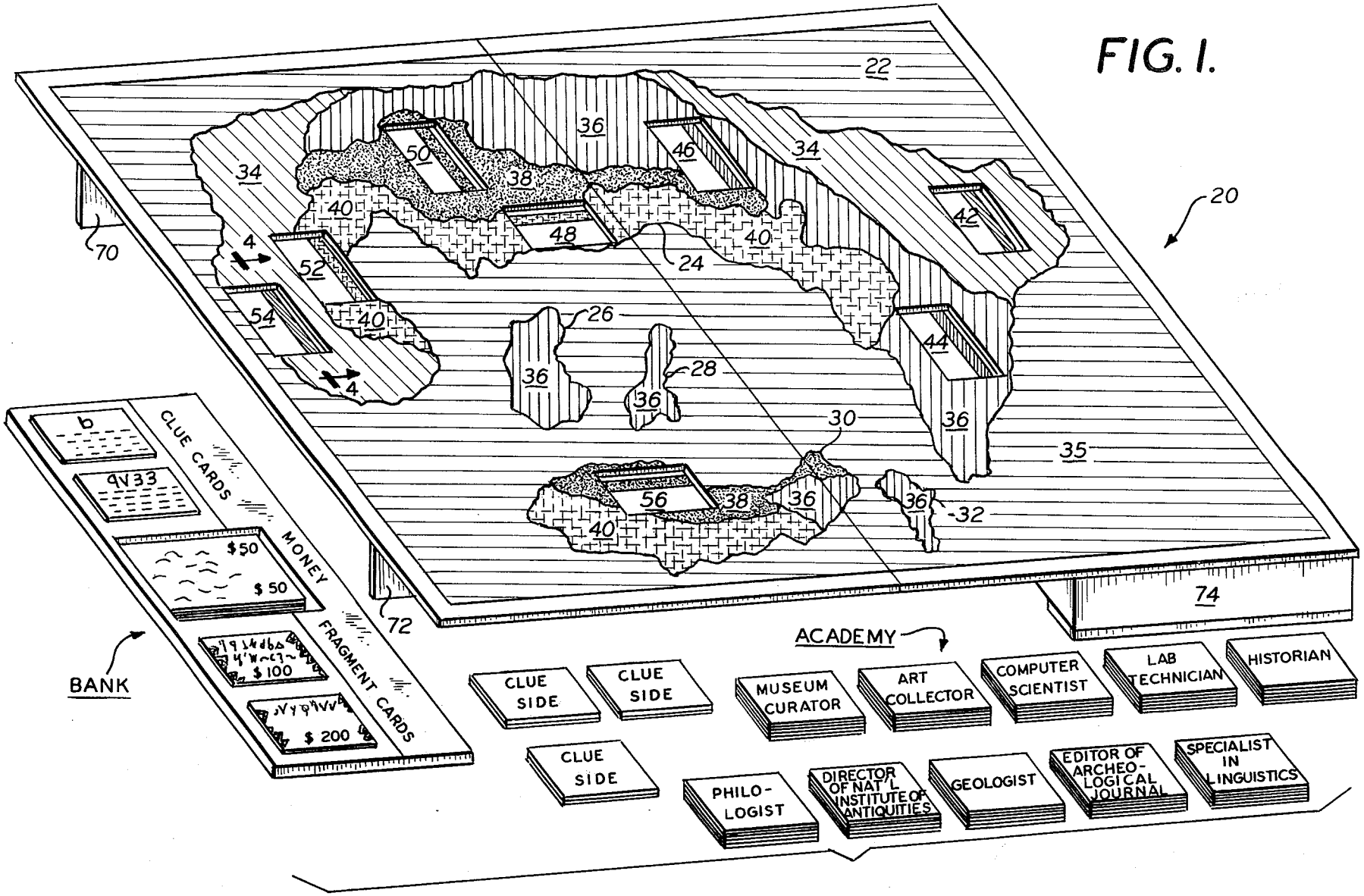
FIG. 1 is a perspective view of the preferred game board and associated game apparatus in accordance with the preferred archeological game of the present invention.

Referring now to the drawings in detail, and initially to FIGS. 1 through 5, the preferred game board, generally referred to by the reference numeral 20 for use in playing the preferred archeological game of the present invention is shown. The preferred archeological game is preferably played by a plurality of players with the object of the game being to find an ancient buried civilization, termed the Great Civilization. The game board 20 preferably comprises a maplike area 22 defining an archeological location in which information associated with this ancient buried civilization is located. By way of example, the maplike area is shown as illustrating a group of small islands 24, 26, 28, 30 and 32 located in an ocean 34. The islands 24 through 32 comprising the maplike area 22 are preferably divided into a plurality of different color coded adjacent areas 34, 36, 38 and 40 preferably being illustratively color coded as green for areas 34, red for areas 36, black for areas 38, and yellow for areas 40, although different colors or a different manner of coding may be utilized if desired. The color coding 34, 36, 38 and 40 each relates to a different rock stratum of a different adjacent historical age relative to the period of the ancient buried civilization. As shown and preferred, there are eight possible sites 42, 44, 46, 48, 50, 52, 54, and 56 for making an archeological dig. The location of a dig may be randomly selected by the player as will be explained in greater detail hereinafter. The color coded strata 34, 36, 38 and 40 are preferably arranged, by way of example, with the oldest stratum being the green stratum 34, the next oldest stratum being the red stratum 36, the next oldest stratum after that being the black stratum 38 above it and the stratum of most recent origin being the top stratum or yellow stratum 40. As further shown and preferred, in each of the stratum 34, 36, 38 and 40 on the maplike area 22, there are two sites of the eight for an archeological dig, sites 42 and 54 being in the green stratum 34, sites 44 and 46 being in the red stratum 36, sites 50 abd 56 being in the black stratum 38, and sites 48 and 52 being in the yellow stratum 40.

As shown and preferred and indicated in greater detail in FIGS. 2 through 5, a recessed pocket is preferably provided in the game board 20 at each of the archeological dig sites 42 through 56. The recessed pocket, such as at archeological dig site 54 by way of example, which is illustrated in greater detail in FIGS. 4 and 5, is preferably formed by means of a slot 60 in the game board 20 which board 20 is preferably formed of a resilient cardboard material which provides side flaps 62 and 64 which are normally resiliently biased due to their composition towards a closed position, as illustrated in FIGS. 2 and 3, by way of example. Before playing the game, a card support platform, such as platform 66 is inserted in the slot 60 and is preferably slightly wider than the width of this slot 60 so as to be resiliently held in position by the biasing of side flaps 62 and 64, as is illustrated in FIG. 4. The appropriate platform card 66 upon insertion of the various cards associated with the dig sites 42 through 56 is preferably marked with indicia indicating the rock strata to which they belong, as is illustrated in FIG. 5, although this is not necessary. However, in the preferred embodiment illustrated in FIGS. 1 through 5, when the game is played, the pockets are held open by means of these pocket inserts. If desired, however, any other type of pockets could be provided in the game board or, if it desired not to provide pockets, any other means of locating archeological dig sites on the game board 20 may be provided. As will be described in greater detail hereinafter, the purpose of the various dig sites 42 through 56 is to contain fragment cards, to be described in greater detail hereinafter, which contain the fragments to be dug up from that stratum. As also shown and preferred in FIGS. 1 through 3, the game board 20 preferably consists of two foldable half portions **20*a* and 20*b* with a pair of pivotally mounted fold out leg supports 70 and 72 which are of sufficient length when folded out to support both unfolded halves of the board 20 in an elevated position above a work surface, the purpose of this being to allow for the depths of the various pockets comprising the dig sites 42 through 56. In addition, as shown and presently preferred, if desired, a container 74 for housing the various cards and game implements utilized in playing the preferred archeological game of the present invention is provided under the game board 20, which game board 20 is shown in its folded position, which is its storage position, in FIG. 3.**

In playing the preferred archeological game of the present invention, there are relatively few types of playing pieces, the playing pieces consisting of fragment cards, some of which contain encrypted language symbols indicia thereon associated with one of a predetermined plurality of different encrypted languages, such as preferably four languages, as will be described in greater detail hereinafter, only one of which generally belongs to the ancient buried civilization, and some of which fragment cards contain indicia thereon not genuinely associated with the ancient civilization, such as forgeries or imports from outside of maplike area 22 in which the ancient buried civilization is located; clue or C cards which contain indicia for decrypting the encrypted language symbols contained on the fragment cards, this indicia relating to the genuine meaning of the language symbols and evidence of the association between the language symbols and the ancient buried civilization; and money of various denominations for use in buying and selling clue cards during the playing of the game, and for making digs, as will be described in greater detail hereinafter.

All fragment cards preferably are color coded, with the color code of a fragment being the color code, preferably, of the stratum 34 through 40, from which it comes, such as a green fragment coming from the green stratum 34, etc. During the playing of the game, this color coding of the fragment cards, except for forgeries as will be described in greater detail hereinafter, provides information not only as to what stratum 34 through 40 a particular fragment card comes from but also whether it is older or younger than fragments of other colors since the color coded strata is in accordance with age; for example, the green fragment card being older than fragments of other colors and a yellow fragment card being younger than any of the other fragment cards of the other colors.

Figures 6, 7, 8, 9:
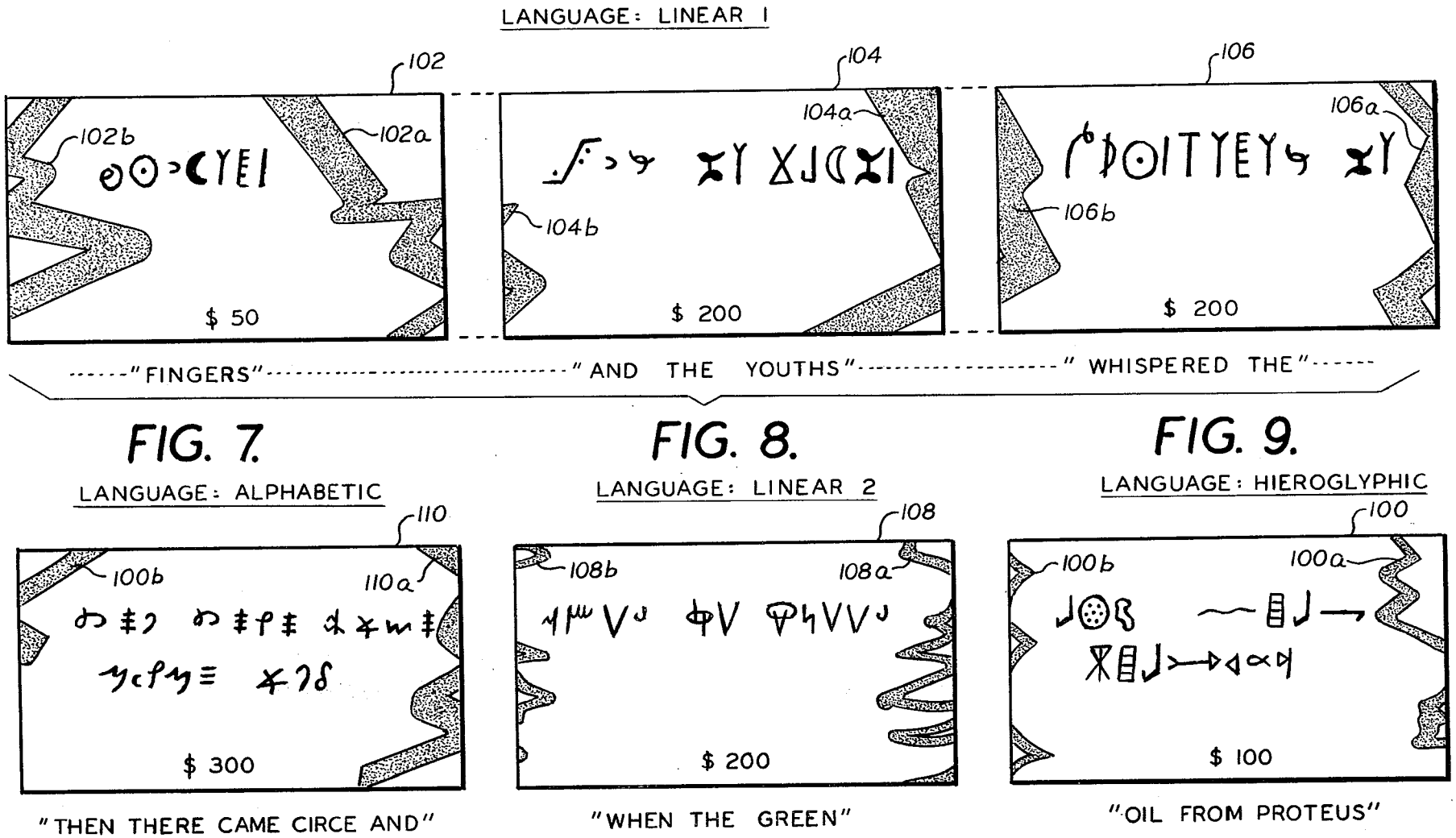
FIG. 6 is an example of a typical encrypted message in a typical language of the game termed "Linear 1"
FIG. 7 is a plan view of a typical fragment card in another typical language of the game termed "Alphabetic"
FIG. 8 is a plan view of another typical fragment card in another typical language of the game termed "Linear 2"
FIG. 9 is still another typical fragment card illustrating another typical language of the game termed "Hieroglyphic"
Figure 11A:
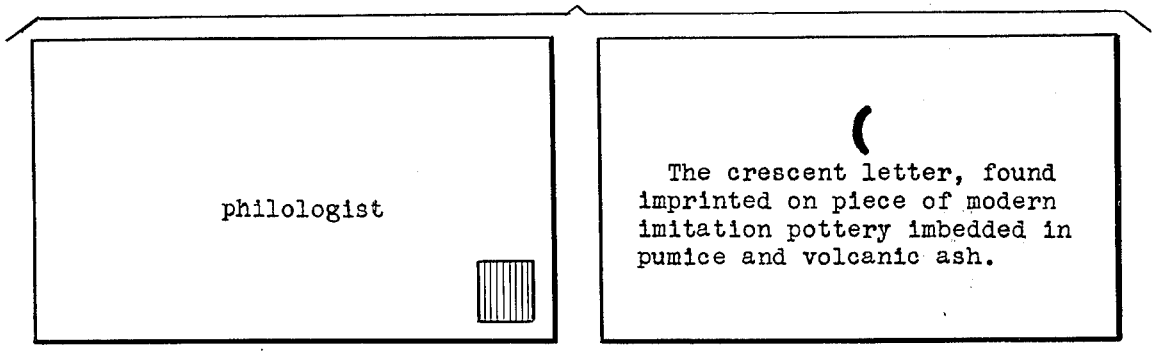
FIGS. 11A through 11D are plan views of other typical clue cards or C cards which show the respective front and back views thereof and further illustrate the association of the clue cards with various professions.
Figure 11B:
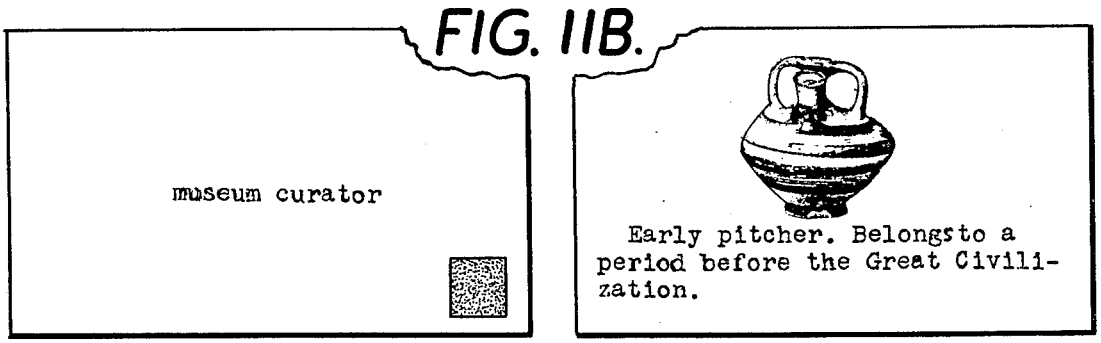
Figure 11C:
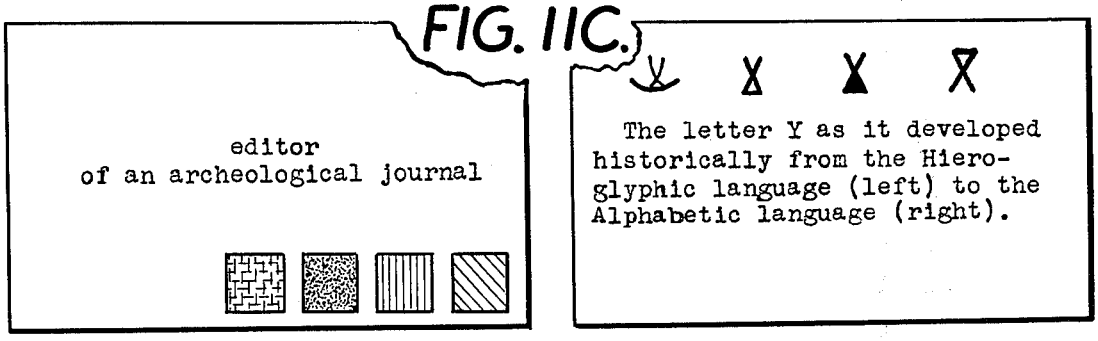
Figure 11D:
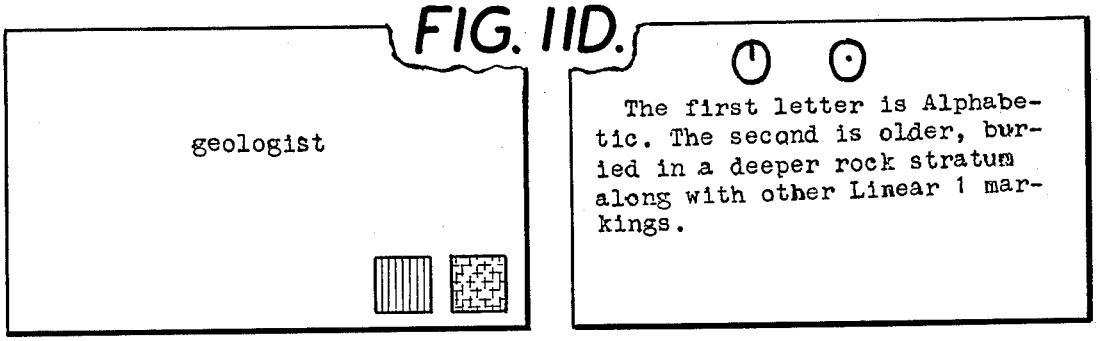

As shown by way of example in FIGS. 6 through 9, the fragment cards preferably contain one of four different encrypted languages thereon, each of these languages preferably being an ancient language associated with the maplike area 22 on the game board 20 but, as will be explained in greater detail hereinafter, only one of these languages being the language of the ancient buried civilization for any given game, with this language being randomly variable from game to game. These four languages are preferably termed "Hieroglyphic", as illustrated on the fragment card 100 in FIG. 9; "Linear 1" as illustrated on the three fragment cards 102, 104, and 106 in FIG. 6; "Linear 2" is illustrated on the fragment card 108 in FIG. 8; and "Alphabetic" as illustrated on the fragment card 110 in FIG. 7. Preferably, these ancient languages are fictional but for realism are modeled after four realistic ancient languages. Each of the four languages has an associated decipherment or translated text for use in playing the game, the decipherment for "Alphabetic" being illustrated in FIGS. 15A and 15B taken together, the decipherement for the "Hieroglyphic" language being illustrated in FIGS. 16A and 16B taken together; the decipherement for the "Linear 1" language being illustrated in FIGS. 17A and 17B taken together; and the decipherement for the "Linear 2" language being illustrated in FIGS. 18A and 18B taken together. Each of the genuine fragment cards, such as 100 through 110, by way of example, except for picture evidence, contains a portion of the associated language decipherement, such as the typical message portion illustrated in FIGS. 6 through 9. As is also shown and preferred, the fragment cards, such as typically shown by fragment cards 100 through 110, contain geometric representations, such as 100*a*, 100*b* for fragment card 100, 102*a* an 102*b* for fragment card 102, 104*a* and 104*b* for fragment card 104, 106*a* and 106*b* for fragment card 106, 108*a* and 108*b* for fragment card 108, and 110*b* for fragment card 110, which are mateable with adjacent fragment cards containing the adjacent portions of the associated language decipherement. The mateability of these adjacent portions is obtained when proper alignment of the geometric portions, such as 102*a* and 104*b* and 104*a* and 106*b* illustrated in FIG. 6, occurs. Thus, in such an instance, as is illustrated in FIG. 6 which shows a preferred mating of three fragment cards 103, 104 and 106 associated with the encrypted language Linear 1, the message "FINGERS AND THE YOUTHS WHISPERED THE" which is a message portion of the Linear 1 decipherement contained in location 120 in FIG. 17B. All the fragment cards for each given language preferably comes from a different stratum and there are preferably an equal number, such as preferably 50 fragment cards of each language, there thus being 50 green fragment cards with Hieroglyphic symbols, 50 red fragment cards with Linear 1 symbols and so forth. As shown and preferred in the various decipherements of FIGS. 16A through 18B, Hieroglyphic symbos are preferably created to look like pictures of things, Linear 1 and Linear 2 symbols are created to be thinner strokes of lines and the Alphabetic symbols are created to look like letters of the archaic Greek alphabet for purposes of realism. Thus, there are preferably provided a total of 400 fragment cards, with 200 of these cards containing the aforementioned language symbols and with the balance of these cards containing a selected number of blanks having no information at all, thus forcing the player to lose money as well as time in finding the ancient buried civilization, as will be described in greater detail hereinafter, and with some of these cards containing forgeries which forgeries can be found in any strata with the color code on the forgeries being part of the forgery. Preferably, forgeries look like fragments of the aforementioned four ancient languages but have mistakes, such as symbols on them which are not correctly written. During the playing of the game, any fragment card with a mistake is to be considered a forgery and, as will be described in greater detail hereinafter, these forgeries are detected with the aid of clue or C cards. In addition, the fragment cards may contain imports which are fragments of imported pottery the symbols on them belonging to a language of a country other than the country depicted in the maplike area 22. These imports, as will also be described in greater detail, are also detected with the aid of the clue or C cards. The fragment cards may also contain potters' designs. Lastly, the fragment cards also preferably contain cards termed power cards, one preferably relating to a village sorceress and another to a customs inspector, with the various power cards containing these names on them giving the players the power stated on the cards, this power preferably being usable once with the card then being discarded. As will also be described in detail hereinafter, fragment cards each have an associated monetary value in the game with the figure showing a fragment card's worth preferably appearing on the bottom of the fragment card, such as illustrated in FIGS. 6 through 9. By way of example, card 100 is worth $100, card 102 is worth $50, card 104 is worth $200, card 106 is worth $200, card 108 is worth $200 and card 110 is worth $300. Some fragment cards have no monetary indication of worth on them indicating to the player that the fragment card has no value. As will be described in greater detail hereinafter, the monetary value indicated on the fragment card becomes important if the player desires to sell the fragment card to raise money to buy clue cards.

Preferably, in playing the game, there are ten professions which, as illustrated in FIG. 1, are preferably "Museum Curator," "Art Collector," "Computer Scientist," "Lab Technician," "Historian," "Philologist," "Director of National Institute of Antiquities," "Geologist," "Editor of Archeological Journal," and "Specialist in Linguistics," all of these professions being conventionally associated with archeology. There are preferably 200 clue or C cards with 20 such clue cards being associated with each profession. The profession with which the various clue cards are associated is printed on one side of the clue cards and is illustrated in FIGS. 11A through 11D with the clue indicia or information being printed on the other side of the clue cards, such as the type of information illustrated in FIGS. 10A to 10H, 11A through 11D, 12A through 12H, 13A through 13H, and 14A through 14H. As previously described, clue cards include information about things which can be found on the fragment cards and thus, can be utilized to give the meaning of symbols, found on the fragment cards, such as illustrated in FIGS. 10A through 10H; clues about forgeries, imports and potters' designs, such as illustrated in FIGS. 12A through 12H; they may give evidence relating to the language of the ancient buried civilization, termed the "Great Civilization" such as illustrated in FIGS. 13A through 13H, and may also contain other evidence of the meaning of symbols which may be useful in locating evidence of the ancient buried civilization, or in locating the genuine language of the ancient buried civilization, or in decrypting or deciphering this language, such as illustrated in FIGS. 14A through 14H. Preferably, if the meaning of a symbol is uncertain, question mark indicia are provided therewith. As will be described in greater detail hereinafter, clue cards not only can be utilized in playing the game to give evidence that the player has located the ancient buried civilization, but may also be utilized to attack evidence in an opponent's hand which is to show that a fragment card does not mean what the opponent says it means, or that a particular fragment card does not belong to the ancient buried civilization. In addition, as shown and preferred in FIGS. 13E through 13H, the game also includes picture evidence which when a player has both the clue card and the matching fragment card may be utilized to provide evidence that fragment cards from the stratum associated with the color code of the matching clue card belong to the ancient buried civilization. Thus, each clue card, such as illustrated in FIGS. 11A through 11D, preferably contains one or more color codes thereon having the associated colors of the various strata, with clues about fragment cards from a stratum being given on the clue cards having the color code or codes of that stratum. A matching picture evidence described above, as with other clue cards, can also be utilized against other fragment cards to show that fragments from a given stratum do not belong to the ancient buried civilization.

In playing the preferred archeological game, clue cards can be utilized as evidence only if they are in a player s hand with the use of a clue card as evidence counting as one lead and with the clue card only being able to count as evidence of one thing. For example, a clue card used as evidence of meaning cannot count as evidence of which fragments belong to the ancient buried civilization nor can a clue card used as evidence for some fragment also may be used as evidence against others. Furthermore, a picture clue card preferably only counts as one lead if the player has both the picture clue card and the matching picture fragment card in his hand. Lastly, a player cannot use a clue card as evidence against fragment cards in another player's hand if the clue card gives evidence against his own hand as well.

Preferably, in playing the preferred archeological game, there are three steps to winning the game, the first step being finding fragment cards of the language of the ancient buried civilization, the next step being discovering what these fragment cards mean, and, thereafter, collecting evidence, using clue cards, showing that the fragments which a player has in his hand belong to the ancient buried civilization and mean what the player says they mean. Thus, summarizing the above, by interrelating or cooperatively associating the clue cards obtained by the player with the fragment cards in his hand, the player initially determines the language of the ancient buried civilization from the four possible languages. The player thereafter subsequently decrypts a predetermined quantity of these fragment cards in this initially determined language to decipher or translate the language symbols thereon in the initially detemined language. The ancient buried civilization is then "found" by the player, who then wins the game, when the predetermined quantity of fragment cards is translated and identified by the clue cards as genuinely belonging to the ancient buried civilization. This language which is initially determined as belonging to the ancient buried civilization may be randomly varied from game to game dependent on the random arrangement and selection of the clue and fragment cards previously described.

In playing the game the map board 20 is set up with the pockets extended via the pocket inserts 66. The four packs of fragment cards, one pack per stratum, are separated and shuffled to provide four randomly arranged stacks, one for each stratum. Each pack is preferably divided in half with one half of the pack, indicia side facing down, being placed into each of the two associated pockets or dig sites for each stratum. The clue cards are preferably separated by profession with, therefore, ten packs of twenty cards each being provided as shown in FIG. 1. Each of these packs is shuffled to randomly arrange the clue cards in a stack with the packs or stacks of clue cards, profession side up, being placed on a surface next to the game board 20. As shown and preferred in FIG. 1, the clue card area is called the "Academy" and during the progress of the game, fragment cards may be sold to the "Academy" for the amount indicated on the face of the fragment cards, with fragment cards without value being discarded. During the playing of the game, sold fragment cards cannot be repurchased. However, clue cards, which may also be sold to the "Academy" for a fixed price, such as $50 each, may be repurchased by any player during his turn as will be described in greater detail hereinafter. Clue cards which are sold to the "Academy" are preferably spread out clue side up, as illustrated in FIG. 1, on the surface next to the game board 20. Those clue cards which have not yet been bought by any player and which are connected in the previously mentioned ten stacks may not be turned over before being initially purchased by a player. The dealer distributes two $50 and two $100 money coupons to each player at the start of the game as well as distributing four fragment cards from any, or several, of the recessed pockets selected at random, the player choosing the pockets he wants his four fragments taken from for distribution by the dealer. As was previously mentioned, each fragment card pack may also contain blank cards and at the start of the game, the player having the least blanks in the initially distributed four fragments cards begins the game with the turns thereafter preceeding clockwise. In the event two players tie at the start of the game, the one with the more valueable monetary hand goes first. When it is his turn, a player can make one or more digs at one, or several, of the eight locations or sites 42 through 56 on the maplike area 22, with the player paying $100 for a dig. The player making the dig draws a fragment card from one of the recessed pockets 42 through 56 at the location of the dig and deposits the $100 in the bank, which bank is illustrated in FIG. 1. As was previously mentioned, the player may also buy clue cards during his turn with an unexposed clue card in one of the ten profession stacks costing $150 and an exposed clue card, that is one placed clue side up, and which has been previously sold to the "Academy", costing $300. Instead of digging or buying clue cards a player may elect to sell fragment cards or clue cards, the sale of clue cards having been discussed above. Furthermore, during his turn a player may dig and buy clue cards or sell what he does not want, although a player may not dig and sell or buy and sell in one turn. When a player believes he has gathered enough fragment and clue cards to assert that he has found the ancient buried civilization, the player lays out his hand for the other players to see. Preferably, this hand must show at least four fragments from the same stratum or two fragments that are mateable at the borders, such as illustrated in FIG. 6, which mated cards form a portion of the decipherement message. The player then must define the meaning of the symbols on the fragment cards utilizing the information provided on his clue cards. He then must show evidence on the clue cards that one or more of these fragment cards belongs to the ancient buried civilization or "Great Civilization." The player who makes this move termed a breakthrough move, wins the game unless another player makes a counter move which is the same as the breakthrough move except that the player who makes the counter move must show fragment cards from a different strat. In such an instance, the evidence in each player's hand is then scored with a clue card used as evidence counting as one lead and a player's score being the number of leads in his hand. Clue cards used as evidence against are not included in this score, the clue card with evidence against another player's hand being a lead against another player and this lead being subtracted from the other players' score. In such an instance, that is when a counter move is made, the player with the highest score wins the game; however in the event of a tie, the game continues until another breakthrough move is made. It should be noted that preferably the player who makes the breakthrough may not sell clue cards or fragment cards in the same turn.

By utilizing the above archeological game apparatus a realistic archeological game utilizing common archeological techniques for locating an ancient buried civilization can be played by a plurality of players.

What is claimed is:

1. An archeological game apparatus for a plurality of players to simulate the finding of an ancient buried civilization comprising a game board having a map delineated thereon representing an archeological location in which information associated with said ancient buried civilization is located, said maplike area being partitioned into a plurality of distinguishably coded contiguous subareas each representing a stratum of a different historical age; a plurality of indicia bearing fragment cards locatable at predetermined locations in each of said distinguishably coded subareas and arrangable at said locations in randomly arranged stacks for selection thereform; said plurality of fragment cards comprising a plurality of distinguishably coded decks, a portion of the cards in each respective deck having inscribed thereon symbols representing encrypted language indicia of a first type, said symbols collectively defining an ancient language uniquely associated with said respective deck, said language indicia of the first type thereby defining a unique encrypted language for each of said distinguishable decks; at least one decipherment for each of said encrypted languages assigning meaning to the symbols belonging thereto; a portion of the cards in each of the respective decks which bear said first type of indicia further having thereon a second type of confusing indicia comprising symbols resembling the encrypted language indicia of said first type borne by said cards but unrelated thereto and having no sensible meaning according to any decipherment associated therewith; stratum code indicia associated with each said deck and identical indicia associated with each said subarea for defining a one -to - one correspondence therebetween whereby each said subarea is uniquely associated with one and only one said deck; and a plurality of also bearing said stratum code indicia arrangable clue cards in at least one randomly provided stack for selection therefrom, said clue cards containing indicia for decrypting said encrypted language symbols contained on said fragment cards including indicia relating to the genuine meaning of said language symbols and evidence of the association between said language symbols and said ancient civilization, said clue cards having at least one code thereon corresponding to a particular stratum code, said clue cards being cooperatively associated only with those fragment cards having said same stratum code thereon, said clue cards and fragment cards being cooperatively associated in order to initially determine the language of said ancient civilization from said plurality of different languages and for subsequently decrypting a predetermined quantity of said fragment cards in said initially determined language to translate the language symbols thereon in said initially determined language, said ancient civilization being found when said predetermined quantity of fragment cards is translated and identified by said clue cards as genuinely belonging to said ancient civilization, said lanugage to be initially determined being randomly variable from game to game dependent on the random arrangement and selection of said clue and fragment cards.

2. An archeological game apparatus in accordance with claim 1 further including simulated currency and wherein said clue cards each have a predetermined associated purchase value, each player being initially provided with a predetermined quantity of said currency for purchasing said clue cards at their respective purchase values on a given turn, said clue cards also being redeemable at said associated purchase value to increase a player's purchasing power on a given turn.

3. An archeological game apparatus in accordance with claim 1 wherein said strata are color coded, with a different color being used for each stratum.

4. An archeological game apparatus in accordance with claim 1 wherein said plurality of different languages comprises four.

5. An archeological game apparatus in accordance with claim 1 wherein a portion of said fragment cards includes forged symbols thereon and said plurality of clue cards includes a portion thereof having indicia thereon definitive of said forged symbols for indicating that said forged symbols are not genuine.

6. An archeological game apparatus in accordance with claim 1 wherein a portion of said fragment cards includes imported symbols from a region outside said maplike area, said imported symbols being not genuine with respect to said ancient civilization, and said plurality of clue cards include a portion thereof having indicia thereon definitive of said imported symbols for indicating that said imported symbols are not genuine.

7. An archeological game in accordance with claim 1 wherein at least a portion of said fragment cards belonging to at least one of said decks each bear additional indicia of a third type enabling a plurality of the cards of said portion to be sequentially associated by correlation of said third type of indicia borne thereby to form a message in a particular one of said languages when said cards of said portion are mated together in adjacent sequence via said additional indicia.

8. An archeological game in accordance with claim 1 wherein said game board comprises pockets at each of said predetermined locations for holding said fragment card random stacks.

* * * * *